United States Patent [19]

Kasai et al.

[11] 4,417,827

[45] Nov. 29, 1983

[54] STICK-TYPE COSMETIC APPLICATOR

[75] Inventors: Yutaka Kasai, Yokohama; Satoru Naramoto, Kashiwa, both of Japan

[73] Assignee: Shiseido Company, Ltd., Japan

[21] Appl. No.: 262,610

[22] Filed: May 11, 1981

[30] Foreign Application Priority Data

May 20, 1980 [JP] Japan ..... 55-69061[U]

[51] Int. Cl.[3] ..... A45D 40/06

[52] U.S. Cl. ..... 401/68; 401/77; 401/78; 401/98

[58] Field of Search ..... 401/77, 98, 78, 75, 401/68

[56] References Cited

U.S. PATENT DOCUMENTS

| | | | |
|---|---|---|---|
| 1,568,178 | 1/1926 | Noble | 401/78 |
| 1,646,358 | 10/1927 | Noble | 401/78 |
| 1,966,884 | 7/1934 | Coe | 401/78 |
| 1,994,074 | 3/1935 | Kendall | 401/78 |
| 2,629,488 | 2/1953 | See | 401/78 |
| 2,704,598 | 3/1955 | Casey | 401/68 |
| 2,823,796 | 2/1958 | Schwartz et al. | 401/75 |
| 2,964,172 | 12/1960 | Landen | 401/75 |
| 3,309,728 | 3/1967 | Seaver | 401/78 X |
| 3,310,168 | 3/1967 | Landen | 401/78 |

FOREIGN PATENT DOCUMENTS

| | | | |
|---|---|---|---|
| 592398 | 8/1925 | France | 401/78 |
| 1042788 | 11/1953 | France | 401/78 |
| 512961 | 2/1955 | Italy | 401/78 |
| 853306 | 11/1960 | United Kingdom | 401/78 |
| 1323513 | 7/1973 | United Kingdom | 401/78 |
| 2026983 | 2/1980 | United Kingdom | 401/68 |

*Primary Examiner*—Steven A. Bratlie

*Attorney, Agent, or Firm*—Austin R. Miller

[57] ABSTRACT

A stick-type cosmetic applicator comprising: a solid cosmetic; a housing sleeve for said solid cosmetic; a sliding sleeve which has a solid cosmetic holder at the top thereof which holder moves along the inner surface of said housing sleeve; a driving sleeve which has at least a continued spiral groove on the inner surface thereof; a guide sleeve which is installed into said driving sleeve and has at least one longitudinal slot for guiding a pin which is provided on said sliding sleeve and engages with said spiral groove through said slot; an intermediate sleeve which is installed onto the outer side of the lower portion of said housing sleeve and receives a cap, and; an outer sleeve installed onto the outer side of the lower portion of said intermediate sleeve. Said guide sleeve and said driving sleeve are disposed below said housing sleeve.

2 Claims, 15 Drawing Figures

STICK-TYPE COSMETIC APPLICATOR

FIELD OF THE INVENTION

The present invention relates to a cosmetic applicator, more particularly to a stick-type cosmetic applicator for solid cosmetics, such as a lipstick, eyebrow pencil, mascara and other solid cosmetic materials.

BACKGROUND OF THE INVENTION

Stick-type cosmetic applicators which allow a solid cosmetic contained therein to be projected and retracted have been well known. Such a cosmetic applicator comprises: a housing sleeve for a solid cosmetic; a sliding sleeve which holds said solid cosmetic and moves up and down along the inner surface of said housing sleeve; a driving sleeve which has a continued spiral groove on its inner surface for moving said sliding sleeve; a guide sleeve having a longitudinal slot for guiding a pin which is provided on said sliding sleeve and engages with said spiral groove; an intermediate sleeve installed on the outer side of the lower portion of said solid cosmetic housing sleeve, and; an outer sleeve installed on the other side of the lower portions of said intermediate sleeve.

In the stick-type cosmetic applicator disclosed in the prior art, the driving sleeve and the guide sleeve are disposed within the solid cosmetic housing sleeve so that the sliding sleeve moves up and down with the solid cosmetic within the guide sleeve along the longitudinal slot of the guide sleeve. With such construction, assembly is difficult and the outer diameter of the cosmetic applicator is large since the driving sleeve and the guide sleeve are disposed in layers around the solid cosmetic.

Usually, the driving sleeve is made of a thermoplastic synthetic resin, such as acrylonitrile-styrene or acrylonitrile-butadiene-styrene, while the intermediate sleeve and the outer sleeve disposed around the driving sleeve are made of a metal, such as aluminium, which has the requisite machinability, strength and appearance. The cosmetic material, in a melted state, is charged into the applicator through the bottom thereof and then solidified therein. The driving sleeve contracts as it is heated during the charging of the melted cosmetic material. This contraction causes a gap between the driving sleeve and the metallic intermediate sleeve, permitting the intermediate sleeve to freely rotate with respect to the driving sleeve. Therefore, when in use, the solid cosmetic does not move smoothly because the rotation of the outer sleeve is not consistently transmitted to the driving sleeve through the intermediate sleeve.

SUMMARY OF THE INVENTION

The present invention provides an improved cosmetic applicator which overcomes the above disadvantages.

An object of the present invention is to provide a stick-type cosmetic applicator in which the number of parts is decreased so that assembly can be easily achieved, thereby decreasing the manufacturing cost.

Another object of the present invention is to provide a stick-type cosmetic applicator in which a driving means, for elevating the sliding sleeve which contains the solid cosmetic, is disposed below the solid cosmetic housing sleeve so that a slim applicator may be produced.

A further object of the present invention is to provide a stick-type cosmetic applicator which operates smoothly and reliably.

In a stick-type cosmetic applicator according to the present invention, the guide sleeve is located at the lower portion of the solid cosmetic housing sleeve and is integrally formed with the housing sleeve. The sliding sleeve is disposed along the entire length of the guide sleeve. The solid cosmetic containing portion at the top of the sliding sleeve moves along the housing sleeve when a pin, which is located at the lower end of the sliding sleeve, moves along a longitudinal slot in the guide sleeve.

In a preferred embodiment of the present invention, the diameter of the guide sleeve is less than the diameter of the solid cosmetic housing sleeve which is integrally formed above the guide sleeve.

In a further preferred embodiment of the present invention, a projection is formed on the outer surface of the driving sleeve, and a slot is formed on the intermediate sleeve for receiving said projection.

DETAILED DESCRIPTION OF THE PREFERRED EMBODIMENTS

Figure 1:
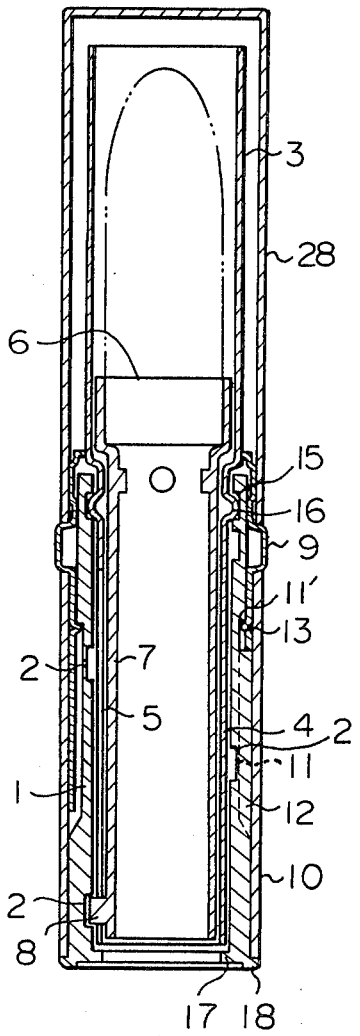
FIG. 1 is a sectional view of a cosmetic applicator according to the present invention.
Figure 2:
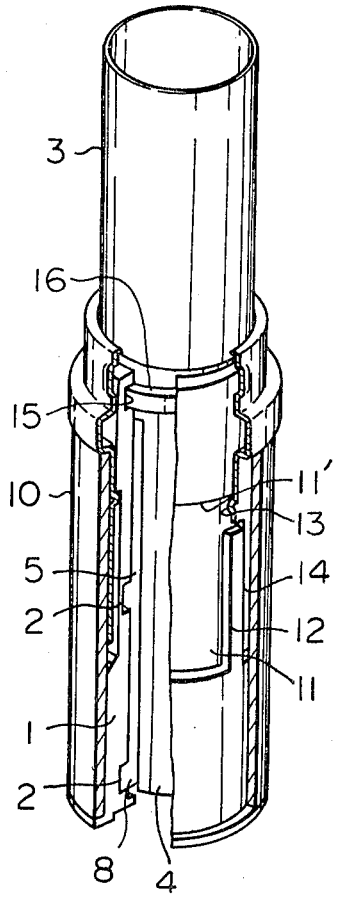
FIG. 2 is a partially broken sectional isometric view of the cosmetic applicator of FIG. 1.
Figure 3:
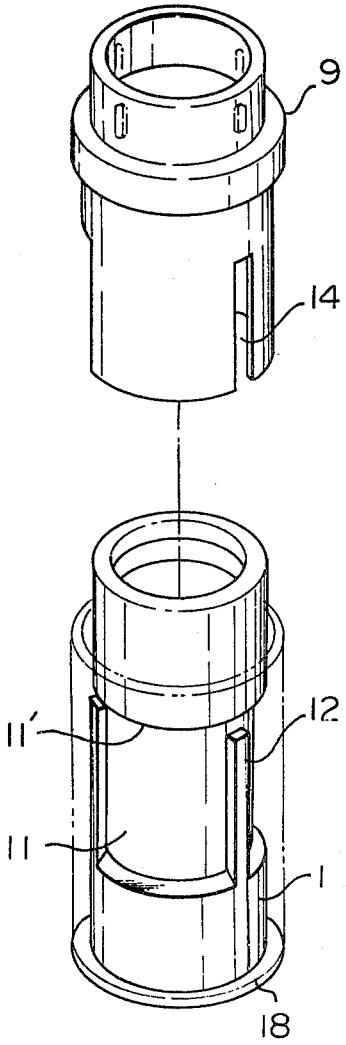
FIG. 3 is an isometric view of a driving sleeve and an intermediate sleeve disposed in the cosmetic applicator of FIG. 1.

A preferred embodiment of the present invention will now be described with reference to FIG. 1 through FIG. 3. The reference numeral 1 designates a driving sleeve which has a spiral groove 2 on the inner surface thereof. The reference numeral 3 designates a solid cosmetic housing sleeve. A guide sleeve 4 is integrally formed with housing sleeve 3. Guide sleeve 4 has two longitudinal slots 5 positioned opposite each other, although only one slot 5 is illustrated in the drawings. The diameter of guide sleeve 4 is less than the diameter of housing sleeve 3. A solid cosmetic holder 6 is integrally formed with and at the top of a sliding sleeve 7. Sliding sleeve 7 is longer than the sliding sleeves of the prior art. Sliding sleeve 7 has two pins 8 at the lower end portion thereof, although only one pin 8 is illustrated in the drawings. Guide sleeve 4 is inserted into driving sleeve 1. Sliding sleeve 7 is inserted into guide sleeve 4. The solid cosmetic holder 6 of sliding sleeve 7 is located within solid cosmetic housing sleeve 3. The pin 8 of sliding sleeve 7 engages with spiral groove 2 through longitudinal slot 5. The solid cosmetic holder 6 moves up and down by rotating driving sleeve 1. An intermediate sleeve 9 is fittedly installed onto driving sleeve 1. An outer sleeve 10 is also fittedly installed onto intermediate sleeve 9 and driving sleeve 1. The diameter of middle portion 11 of the driving sleeve 1 is less than the diameter of the upper and the lower portions of driving sleeve 1. A longitudinal projection 12 is formed on this reduced diameter middle portion 11. A longitudinal slot 14 is formed on intermediate sleeve 9. Projection 12 of driving sleeve 1 engages the longitudinal slot 14 of intermediate sleeve 9. Intermediate sleeve 9 further comprises an annular projection 13 formed on the inner side thereof. This annular projection 13 engages with an annular step 11' formed on the upper part of the middle portion 11 of driving sleeve 1. Driving sleeve 1 has an annular recess 15 on the inner side of the upper end thereof. Guide sleeve 4 has an annular projection 16 on the outer side of the upper portion thereof. Guide sleeve 4 is prevented from being dropped out of driving sleeve 1 by inserting the annular projection 16 into the annular recess 15. An inner flange 17 is formed at the lower end of driving sleeve 1 for supporting guide sleeve 4. An outer flange 18 is also formed at the lower end of driving sleeve 1 to support outer sleeve 10. Flanges 17, and 18 serve as the end cap for the prior cosmetic applicators. Accordingly, the end cap can be replaced by flanges 17 and 18.

Another embodiment of the present invention will be described hereinafter with reference to FIGS. 4 through 15. Like parts are designated by the same reference numerals as the corresponding parts in the aforementioned embodiments.

Figure 4:
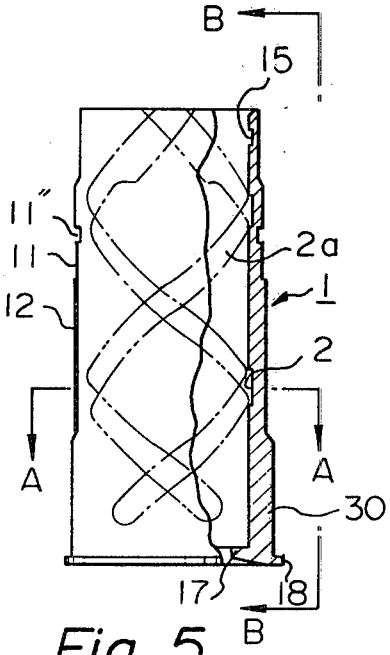
FIG. 4 is a partial sectional view of a driving sleeve according to the present invention.
Figure 5:
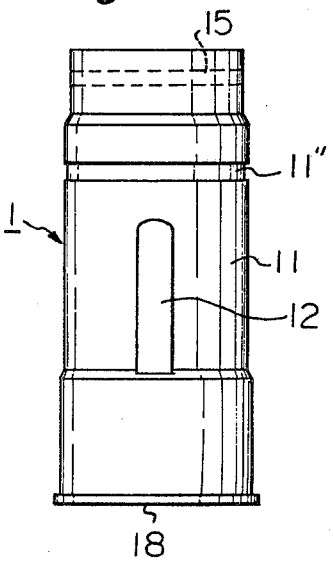
FIG. 5 is a view seen from the direction of arrows B—B of FIG. 4.
Figure 6:
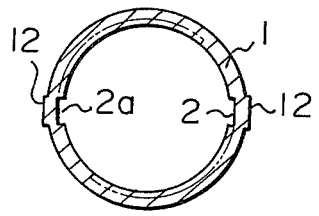
FIG. 6 is a sectional view taken along the line A—A of FIG. 4.
Figure 7:
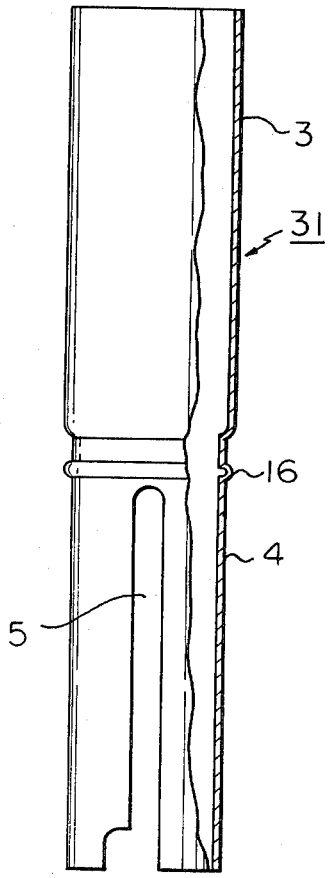
FIG. 7 is a partial sectional view of a combined sleeve composed of a solid cosmetic housing sleeve and a guide sleeve according to the present invention.
Figure 8:
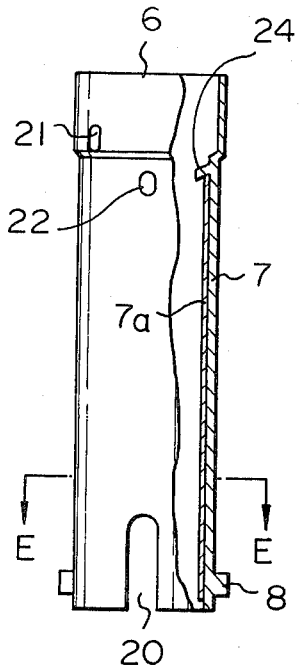
FIG. 8 is a partial sectional view of a sliding sleeve according to the present invention.
Figure 9:
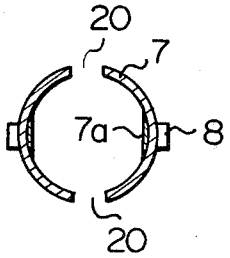
FIG. 9 is a sectional view taken along the line E—E of FIG. 8.
Figure 11:
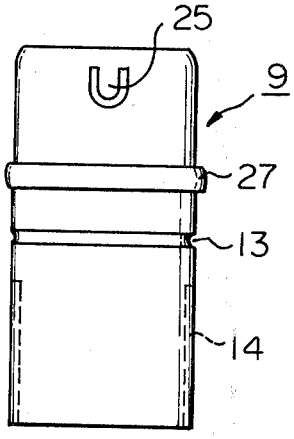
FIG. 11 is a view seen from the direction of arrows D—D of FIG. 10.
Figure 10:
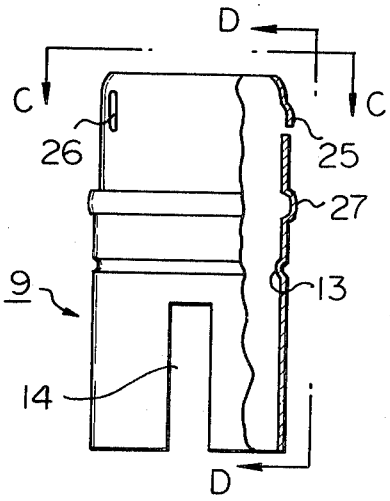
FIG. 10 is a partial sectional view of an intermediate sleeve according to the present invention.
Figure 12:
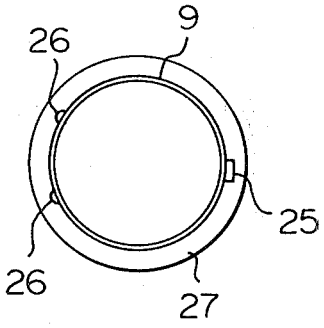
FIG. 12 is a view seen from the direction of arrows C—C of FIG. 10.
Figure 13:
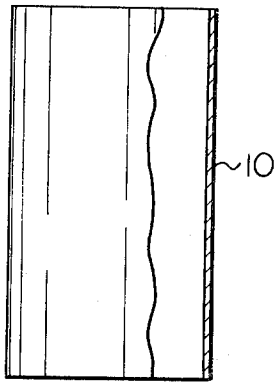
FIG. 13 is a partial sectional view of an outer sleeve according to the present invention.

Two spiral grooves 2 and **2*a* are formed on the inner surface of driving sleeve 1 which is made of synthetic resin, such as acrylonitrile-styrene or acrylonitrile-butadiene-styrene, as illustrated in FIG. 4. An annular recess 15 is formed on the inner surface of the upper portion driving sleeve 1. The diameter of the middle portion 11 of this driving sleeve 1 is less than the diameter of the lower portion 30. An annular recess 11' is formed on the upper part of this middle portion 11. Two longitudinal projections 12 are formed at opposite positions on the side surface of driving sleeve 1 as can be seen from FIGS. 5 and 6. A guide sleeve 4 as illustrated in FIG. 7 is inserted into driving sleeve 1. Guide sleeve 4 is integrally formed at the lower portion of a solid cosmetic housing sleeve 3. Integrally formed sleeves 3 and 4 are made of a metal such as aluminum and form an elongated combined sleeve 31. The diameter of guide sleeve 4 is less than the diameter of housing sleeve 3. Guide sleeve 4 has two longitudinal slots 5 positioned opposite each other on its side surface, although only one slot 5 is illustrated in FIG. 7. An annular projection 16 is formed on the outer surface of the upper portion of guide sleeve 4. This annular projection 16 fits into the annular recess 15 of driving sleeve 1 (FIG. 4) so that driving sleeve 1 is secured onto guide sleeve 4. A sliding sleeve 7 (FIGS. 8 and 9) of synthetic resin is inserted into guide sleeve 4. A holder 6 for a solid cosmetic is formed at the top sliding sleeve 7. Two pins 8 are provided on the lower end portion sliding sleeve 7. Each of the pins 8 engages with the spiral groove 2 or 2*a* of driving sleeve 1 through one of the longitudinal slots 5 of guide sleeve 4. Thickened reinforcements 7*a* are positioned opposite each other on the inner side surface of sliding sleeve 7. Reinforcements 7*a* may be formed integrally with sliding sleeve 7. Sliding sleeve 7 is long enough to be disposed along the entire length of guide sleeve 4. The solid cosmetic holder 6 at the top of sliding sleeve 7 moves along housing sleeve 3 when pins 8 which are located at the lower end portion of the sliding sleeve 7 move along the longitudinal slots 5 of guide sleeve 4. Small projections 21 and 22 are formed on the outer surface of cosmetic holder 6 and also on the outer surface of sliding sleeve 7 so that holder 6 and sliding sleeve 7 are fittedly inserted into housing sleeve 3 and guide sleeve 4, respectively, thereby, avoiding erratic movement of sliding sleeve 7. Two slits 20 (FIG. 9) are formed on the lower end of sliding sleeve 7 to increase the elasticity of sleeve 7 so that sleeve 7 can be easily inserted into guide sleeve 4. An intermediate sleeve 9, made of aluminum, which is illustrated in FIGS. 10 through 12, is installed onto driving sleeve 1. An annular projection 13 is formed on the inner surface of intermediate sleeve 9. This annular projection 13 fits into the annular screen 11" of driving sleeve 1 so that intermediate sleeve 9 is retained on driving sleeve 1. A cap 28 (FIG. 15) is installed onto this intermediate sleeve 9. Two small projections 26 (FIG. 12) and a springly projection 25 are provided on the upper portion of intermediate sleeve 9 so that cap 28 can be reliably installed onto intermediate sleeve 9. The numeral 27 designates a cap stopper. Intermediate sleeve 9 has two longitudinal slots 14 into which projections 12 of driving sleeve 1 fit. Accordingly, rotation of intermediate sleeve 9 can be securely transmitted to driving sleeve 1. An outer facing sleeve 10 is firmly installed onto intermediate sleeve 9**.

Figure 14:
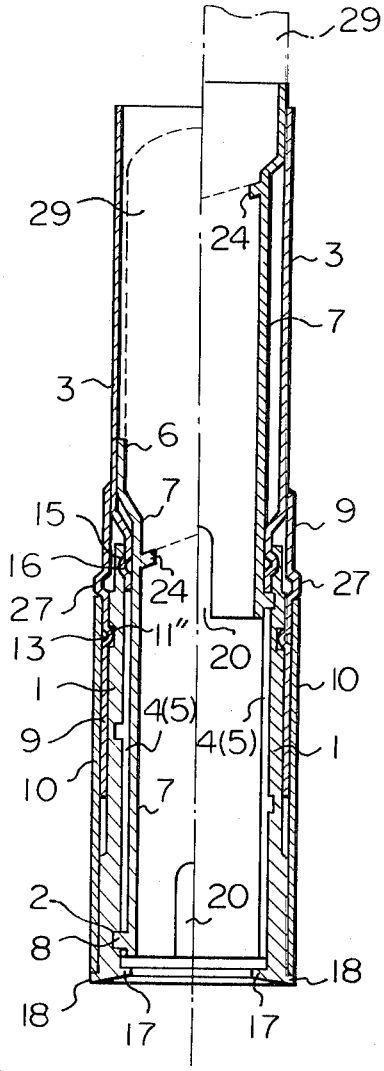
FIG. 14 is a broken sectional view of a cosmetic applicator according to the present invention.
Figure 15:
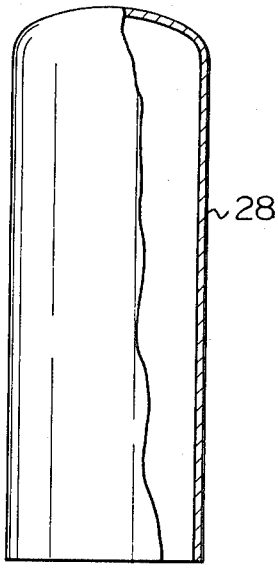
FIG. 15 is a partial sectional view of a cap of the cosmetic applicator.

The above-described parts are assembled to form a cosmetic applicator as illustrated in FIG. 14. In the left half of FIG. 14, solid cosmetic 29 is retracted within housing sleeve 3, while in the right half of FIG. 14, solid cosmetic 29 is projected out of housing sleeve 3.

In operation, outer sleeve 10 is rotated by one hand while housing sleeve 3 is securely held by the other hand. This rotation of outer sleeve 10 is transmitted to driving sleeve 1 through intermediate sleeve 9 so that the spiral grooves 2 and **2*a*, move along longitudinal slots 5 of guide sleeve 4. Pins 8 of sliding sleeve 7 are thereby moved along slots 5 so that solid cosmetic 29, held on sliding sleeve 7**, is moved upward or downward.

As described above, in the stick-type cosmetic applicator according to the present invention, the guide sleeve is integrally formed with the housing sleeve. The diameter of the guide sleeve is less than the diameter of the housing sleeve. The driving sleeve which elevates the sliding sleeve is disposed in the lower portion of the applicator. With construction, the number of parts is decreased, facilitating assembly and thereby decreasing manufacturing cost. Only one sleeve, the housing sleeve, is disposed around the solid cosmetic. Therefore, it is possible to make the cosmetic applicator slim and of the desired profile.

According to the present invention, the sliding sleeve is long enough to be disposed along the entire length of the inner surface of the guide sleeve. The sliding sleeve is constructed so that it securely fits into the guide sleeve and so that the solid cosmetic holder securely fits into the housing sleeve. This allows the cosmetic to move smoothly and thus, erratic movement of the cosmetic is avoided.

According to the present invention, the driving sleeve has at least one longitudinal projection on the outer surface thereof. A longitudinal slot into which the projection fits is formed on the side surface of the intermediate sleeve. Therefore, idle rotation of the intermediate sleeve with respect to the driving sleeve is avoided and rotation of the intermediate sleeve is securely transmitted to the driving sleeve, even where thermal contraction occurs in the driving sleeve during the heating process at the time of charging the melted cosmetic into the applicator. Therefore, consistent and smooth movement of the solid cosmetic can be achieved. The intermediate sleeve may be formed as an integral part of the outer sleeve.

According to the present invention, an annular projection and an annular recess which engage each other are provided on the driving sleeve and the intermediate sleeve so as to firmly engage these sleeves with each other. Also, another annular projection and another annular recess which engage each other are provided on the driving sleeve and the guide sleeve so as to firmly engage these sleeves with each other. Therefore, assembly of the sleeves can be easily and reliably achieved and each of the sleeves can be reliably located at a prescribed position with respect to the other sleeves.

We claim:

1. A stick-type cosmetic applicator comprising:

a sliding sleeve having a solid cosmetic receiving portion for receiving a stick-type cosmetic extending from a first end thereof and having at least one radially extending projection on the outer surface near the second end thereof;

a guide sleeve surrounding said sliding sleeve from said second end to a point intermediate said first and second ends, having at least one longitudinal slot extending from an end of said guide sleeve proximate to said second end of said sliding sleeve, in which said radially extending projection of said sliding sleeve travels, said slot guiding said sliding sleeve and preventing rotation of said sliding sleeve with regard to said guide sleeve, and having an annular projection on the outer surface thereof;

a housing sleeve integrally formed with said guide sleeve, surrounding said solid cosmetic receiving portion of said sliding sleeve and extending therefrom to house said stick-type cosmetic;

a driving sleeve surrounding said guide sleeve having at least one spiral groove for engagement with said radially extending projection of said sliding sleeve, said driving sleeve being rotatable about said guide sleeve and said sliding sleeve, and having an annular recess on the inner surface for engagement with said annular projection on said guide sleeve, an annular recess on the outer surface, a longitudinal projection on the outer surface and flanges on the inner and outer surfaces at the end distant from the cosmetic receiving portion of said sliding sleeve; said inner flange engaging said guide sleeve;

an intermediate sleeve fixedly installed on the outer surface of said driving sleeve and extending onto said housing sleeve having a longitudinal slot for engagement with said longitudinal projection of said driving sleeve and an annular projection;

an outer sleeve fixedly installed on said intermediate sleeve, secured between said annular projection of said intermediate sleeve and said flange on the outer surface of said driving sleeve, rotation of which is transmitted to said driving sleeve through said intermediate sleeve causing said radially extending projection to travel in said spiral groove, said sliding sleeve thereby travelling within said guide sleeve and said housing sleeve; and a cap demountably installed on said intermediate sleeve surrounding said housing sleeve.

2. A stick-type cosmetic applicator for a solid cosmetic comprising:

a housing sleeve for said solid cosmetic;

a sliding sleeve which has a solid cosmetic holder at the top thereof which holder moves along the inner surface of said housing sleeve;

a driving sleeve which has at least one continued spiral groove on the inner surface thereof;

a guide sleeve which is installed into said driving sleeve and has at least one longitudinal slot for guiding a pin which is provided on said sliding sleeve and engages said spiral groove through this slot;

an intermediate sleeve which is installed onto the outer side of the lower portion of said housing sleeve and receives a cap;

an outer sleeve installed onto the outer side of the lower portion of said intermediate sleeve;

in which said guide sleeve and said driving sleeve are disposed below said housing sleeve; said driving sleeve has two spiral grooves, and said guide sleeve has two longitudinal slots which are positioned opposite each other on its side wall; said driving sleeve and said sliding sleeve are made of synthetic resin while said intermediate sleeve, said outer sleeve, said housing sleeve and said guide sleeve are made of metal; said driving sleeve has an inner flange for receiving said guide sleeve and an outer flange for receiving said outer sleeve at the lower end thereof; said guide sleeve and said intermediate sleeve are secured to said driving sleeve by means of a projection and a recess with which said projection engages; and a longitudinal projection is formed on the outer surface of said driving sleeve, and a longitudinal slot for engagement with said longitudinal projection of said driving sleeve is formed on the side wall of said intermediate sleeve.

* * * * *

UNITED STATES PATENT AND TRADEMARK OFFICE

CERTIFICATE OF CORRECTION

PATENT NO. : 4,417,827

DATED : November 29, 1983

INVENTOR(S) : Yutaka Kasai and Satoru Naramoto

It is certified that error appears in the above-identified patent and that said Letters Patent is hereby corrected as shown below:

Column 3, line 37, after "17" delete the comma.

line 51, after "portion" insert --of-- line 53, "11' " should read --11"--

Column 4, lines 5 and 6, before "sliding" insert --of--

Signed and Sealed this

*Twenty-eighth* Day of *August 1984*

[SEAL]

*Attest:*

GERALD J. MOSSINGHOFF

*Attesting Officer*

*Commissioner of Patents and Trademarks*